US005171019A

United States Patent [19]

Arnette

[11] Patent Number: 5,171,019

[45] Date of Patent: Dec. 15, 1992

[54] TETHERED RING AND HOOK GAME AND KIT

[76] Inventor: Grigsby C. Arnette, 7904 Beach Dr., Myrtle Beach, S.C. 29577

[21] Appl. No.: 694,488

[22] Filed: May 2, 1991

[51] Int. Cl.[5] ..... A63B 67/10

[52] U.S. Cl. ..... 273/332

[58] Field of Search ..... 273/332, 331, 333, 334

[56] References Cited

U.S. PATENT DOCUMENTS

| | | | |
|---|---|---|---|
| D. 285,811 | 9/1986 | Donahoe | D21/62 |
| 292,899 | 2/1884 | Davies | 273/332 |
| 2,095,390 | 10/1937 | Lange et al. | 273/332 |
| 2,243,620 | 5/1941 | Fernandez | 273/413 |
| 2,942,886 | 6/1960 | Ackerman | 273/332 |
| 3,009,702 | 11/1961 | Lyon | 273/332 |
| 3,520,535 | 7/1970 | Dubbs et al. | 273/332 |
| 4,635,942 | 1/1987 | Flaherty, Jr. | 273/332 |

*Primary Examiner*—William H. Grieb

*Attorney, Agent, or Firm*—Wigman & Cohen

[57] ABSTRACT

A tethered ring game and kit is disclosed comprising a tethered ring, means for attaching the tether to an overhanging surface, swivel means mounted intermediate the tether and the attachment means for preventing the cord from becoming twisted during use, and an open hook to be mounted on a surface approximately 90° from the overhanging surface and in spaced relation to the attachment means for receiving the tethered ring.

8 Claims, 1 Drawing Sheet

TETHERED RING AND HOOK GAME AND KIT

BACKGROUND OF THE INVENTION

This invention relates to ring and hook games and more particularly to a ring and hook game which is portable, easy to assemble, inexpensive to manufacture, and operative with minimum liklihood of malfunction, wear and tear, and breakage.

1. Description of the Prior Art

Ring and hook games comprising a tethered ring which is swung in a pendulum-like manner towards a mounted hook in an effort to hook the ring have been known for some time. Typically, the hook and tethered ring are mounted to generally "L" shaped frames, either free-standing or adapted to be mounted to a wall. U.S. Pat. Nos. 3,009,702 to Lyon, 2,942,886 to Ackerman, 3,520,535 to Dubbs et al, and Des. 285,811 to Donahoe are examples of such devices.

A key disadvantage of the game apparatus described above is that the frames are bulky, and complex to assemble and susceptible to malfunction. Moreover they are generally expensive to manufacture.

Another disadvantage of these types of devices is the fact that, because of their large size, they cannot easily be sold in a small store such as a gift shop or invention store where such games are frequently sold, but where there is usually limited shelf space. Also, because they are not portable, they cannot be stored in luggage and the like, precluding their use during vacations, picnics and the like.

While hook and ring games which do not employ a frame exist in the art, for example U.S. Pat. No. 292,899 to Davies, such devices are made of expensive and complex materials and are difficult to mount to walls and ceilings. Also, mounting the hook directly to the wall is problematic, especially with walls constructed of plaster, because as the ring hits the hook the vibrations thereby created can cause the attachment between the hook and wall to loosen.

Another key disadvantage of the prior art, both the free-standing type, as well as the wall mounted type, is the fact that if the ring is spun by the player in order to improve the liklihood of catching the hook, the cord becomes twisted thereby requiring the player to periodically untwist the cord.

In view of the foregoing, it should be apparent that a need still exists in the art for a game apparatus that avoids the problems inherent in the prior art games.

SUMMARY AND OBJECTS OF THE INVENTION

It is a primary object of this invention to provide a ring and hook game which can be easily assembled and disassembled.

Another object of this invention is to provide a ring and hook game which, when disassembled, can be stored in a small, clear plastic display pouch which can be mounted to a peg board in a store.

Another object of this invention is to provide a ring and hook game with improved means for securing the ring to a wall.

Yet another object of this invention is to provide a ring and hook game with means to prevent the cord from becoming twisted as the ring is spun.

A further object of this invention is to provide a ring and hook game which can be mounted to a wall without puncturing a hole therein.

These and other objects and advantages that may become apparent hereinafter are accomplished in accordance with this invention by providing a ring and hook game, the preferred embodiment of which is adapted to be mounted directly to a ceiling and wall, generally comprising a brass ring tethered to the ceiling by means of an eye screw mounted to the ceiling to which the tether is tied, a hook support block, adapted to be mounted to a wall by means of a dowel screw, VELCRO® fasteners or the like, and a hook, mounted to the block for receiving the ring. Additionally, a ball-in-socket swivel is provided intermediate the string and the eye screw to prevent tension from building up in the tether as the ring spins during use.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
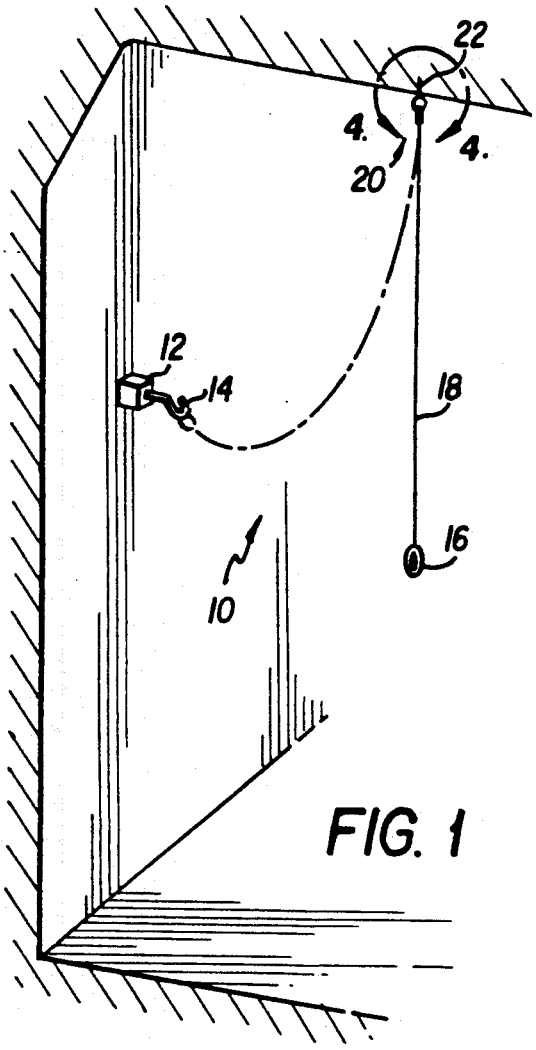
FIG. 1 is a perspective view of the present invention shown mounted to a wall and ceiling in a room.

Referring now in detail to the drawings wherein like parts are designated by like reference numerals throughout, there is illustrated in FIG. 1 a perspective view of the game apparatus of the present invention designated generally by reference numeral 10. Game apparatus 10 generally comprises a mounting block 12, receiving hook 14, ring 16, tether cord 18, swivel 20 and eye screw 22. It is a particular feature of the present invention that all of the above components are inexpensive and, when disassembled, can fit in a small package (4"×6") for ease in sale, storage and transport.

Figure 2:
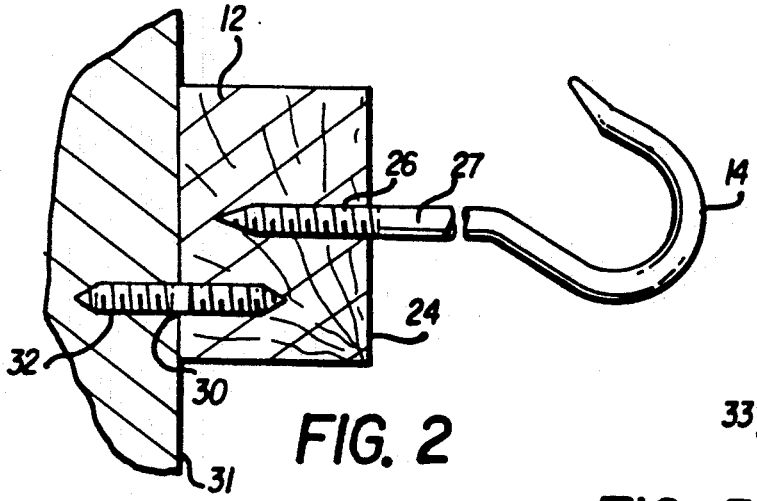
FIG. 2 is an enlarged side elevation view, partly in section, of the ring receiving hook shown in engagement with the mounting block mounted to a wall.
Figure 5:
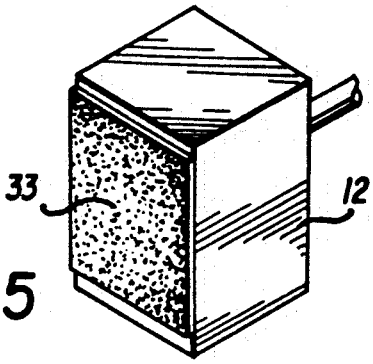
FIG. 5 is a perspective view of an alternative embodiment of the mounting block of the present invention.

In particular, and with reference to FIG. 2 mounting block 12, preferably constructed of white pine wood, is provided on its front face 24 with a first pre-drilled aperture 26 of approximately ¼" diameter and 1" in length and on its rear face 28 with a second aperture 30 of approximately ⅛" diameter and ½" length. Second aperture 30 is adapted to receive a dowel screw 32, threaded at both ends such that the block 12 can be mounted to a wall 31, tree or the like. Alternatively, and with reference to FIG. 5, block 12 can be wall-mounted by means of double-sided foam tape 33 such as the SCOTCH® brand mounting squares, or by the use of VELCRO® hook and loop fasteners.

First aperture 26 is adapted to receive the threaded shank portion 27 of receiving hook 14 thereby supporting the same. Block 12 functions to dampen vibrations created when the ring is swung into hook 14 thereby more adequately securing the hook to the wall.

Ring 16 is preferably constructed of brass or a similar material which is sufficiently heavy so as to keep tether cord 18 taut during the swinging operation and which is also sufficiently hard to avoid being dented or damaged when swung into contact with hook 14 or wall 31. The optimum diameter of ring 16 has been found to be 1 ½". With a ring of this diameter, a user of average skill level should hook the ring approximately one out of twenty-five attempts which is the optimum degree of difficulty. Cord 18 may be made of thin nylon or any other suitable material and is preferably 6–7 feet long.

Figure 3:
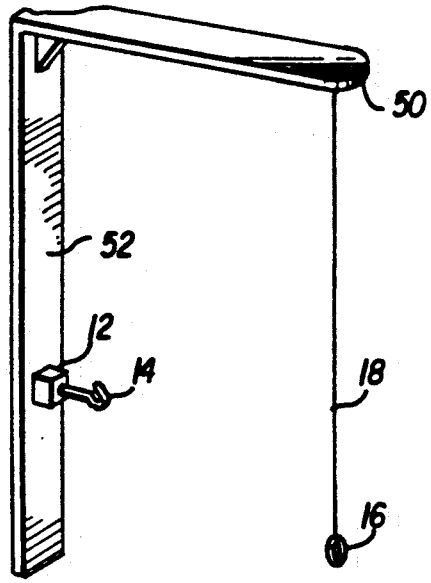
FIG. 3 is an enlarged elevation view of the swivel assembly in the inset shown in FIG. 1.

With reference to FIG. 3 there is shown an enlarged view of eye screw 22 and swivel assembly 20. Swivel 20, to which tether cord 18 is tied, allows ring 16 to spin freely without imparting a twist to cord 18. This is particularly useful since one technique found advantageous in hooking the ring is for the player to cause the ring to spin as it is swung toward the hook. Swivel assembly 20 comprises a pair of wire loop members 36 and 38 each having a ball portion mounted thereto (not shown). A generally barrel shaped socket member 40 having a pair of openings at opposite ends is provided for receiving the ball portions of loop members 36 and 38. This ball-in-socket arrangement allows both loop members 36 and 38 to rotate 360° and to swivel. A hook member 42 having a snap opening and closure means is provided for releasably attaching swivel assembly 20 to eye screw 22.

In use, the player pulls ring 16 and cord 18 away from hook 14 until the cord is taut. The player aims the ring in the direction of the hook and either releases or pushes it so as to cause the ring and cord to swing in a pendulum-like manner. Some players also prefer to spin the ring, a technique which can be accommodated by the present invention. If properly aimed, the ring 16 will swing upwardly past hook 14 and drop downwardly thereon as shown by the dotted lines in FIG. 1.

It is a particular feature of the preferred embodiment that, when disassembled, all of the components can easily fit in a 4"×6" clear plastic pouch for ease in sale, storage and transport.

Figure 4:
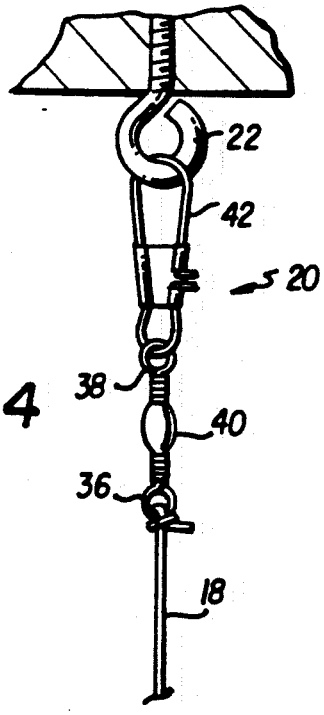
FIG. 4 is a perspective view, partially fragmented, of an alternative embodiment of the present invention.

Referring now to FIG. 4, there is shown an alternative embodiment of the present invention designated generally by reference numeral 50. Embodiment 50 comprises a generally "L" shaped frame 52, preferably constructed of wood, to which all of the components of the preferred embodiment are mounted, namely, the mounting block, receiving hook, ring, tether cord, swivel assembly, and eye screw. (Like components are similarly numbered). Frame 52 may be mounted directly to a wall or may be mounted to a base (not shown) so as to be free-standing.

In sum, the above-described invention has several important advantages over the prior art. First, the addition of swivel assembly 20 allows the player to spin ring 16 without twisting or winding cord 18. Second, with respect to the preferred embodiment, the parts are easily assembled, disassembled, carried and stored. Moreover, the game according to the invention can be readily marketed in a kit form.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A tethered ring game kit having component parts adapted to be easily assembled and mounted to a wall, the kit comprising the combination of:

a cord of sufficient length to tether a ring;

a ring adapted to be tethered and of a weight sufficient to keep the tether taut during swinging;

an eye hook adapted for attaching said tether to an overhanging surface;

swivel means mounted intermediate said tether and said attachment means for preventing the cord from becoming twisted during use;

said swivel means comprising a ball and socket arrangement including a pair of closed loops rotatably joined to an intermediate socket member, one of said closed loops being adapted to be secured to said tether and the other of said loops being adapted to be secured to said attachment means;

an open hook adapted to be mounted on a surface approximately 90° from said overhanging surface and in spaced relation to said attachment means for receiving said tethered ring, said hook having a threaded shank portion;

a block having vibration dampening characteristics for mounting said hook to a wall, said block having a first surface and a second surface opposite said first surface, said first surface having a first aperture adapted to receive said shank of said hook and said second surface having means for removably securing said block to said wall; and a display pouch for holding said component parts therein and for display.

2. The kit of claim 1 wherein said ring is made of brass.

3. The tethered ring game kit of claim 1, wherein said ring is brass; and further comprising a dowel screw for mounting said block, said block includes on its second surface a second aperture adapted to receive said dowel screw.

4. The tethered ring game kit of claim 3, wherein said block is made of wood.

5. The tethered ring game kit of claim 1, wherein said block includes on its second surface an adhesive layer.

6. The tethered ring game kit of claim 5, wherein said block is made of wood.

7. The tethered ring game kit of claim 1, wherein said block includes on its second surface a hook-loop strip.

8. The tethered ring game kit of claim 7, wherein said block is made of wood.

* * * * *